United States Patent [19]

Dahlheimer

[11] Patent Number: 4,773,103

[45] Date of Patent: Sep. 27, 1988

[54] ADJUSTABLE TOILET CLEANER DISPENSER

[76] Inventor: Donald J. Dahlheimer, 2752 Waltham Cross, Belmont, Calif. 94002

[21] Appl. No.: 11,545

[22] Filed: Feb. 6, 1987

[51] Int. Cl.[4] ..... E03D 9/02

[52] U.S. Cl. ..... 4/228; 215/313; 215/309; 222/548

[58] Field of Search ..... 4/228; 215/313, 309; 222/548, 190, 481; 422/263, 269, 274–276

[56] References Cited

U.S. PATENT DOCUMENTS

| | | | |
|---|---|---|---|
| 3,607,103 | 9/1971 | Kiefer | 422/274 |
| 3,781,926 | 1/1974 | Levey | 4/228 |
| 3,867,101 | 2/1975 | Herring | 4/228 |
| 4,299,339 | 11/1981 | Giroux et al. | 215/313 |
| 4,435,858 | 3/1984 | Dolan | 4/228 |

FOREIGN PATENT DOCUMENTS

| | | | |
|---|---|---|---|
| 839370 | 4/1939 | France | 222/548 |
| 471855 | 5/1952 | Italy | 222/548 |
| 3651 | 9/1878 | United Kingdom | 215/313 |

*Primary Examiner*—Henry J. Recla
*Assistant Examiner*—Linda J. Sholl
*Attorney, Agent, or Firm*—Donald C. Feix; T. M. Freiburger

[57] ABSTRACT

A regulating closure for a dispenser of toilet bowl cleaner includes an annular band which snaps onto a cap portion and has generally semicircular openings which can be placed in registry with similar openings in the cap portion, or which can be adjusted to cover all or part of the cap openings by rotation of the annular band. The band, which is snapped into place on the cap portion, is retained thereon by a series of nipples protruding inwardly from the interior side of the annular band, engaged beneath a pronounced annular ridge on the exterior of the cap portion.

2 Claims, 2 Drawing Sheets

ADJUSTABLE TOILET CLEANER DISPENSER

BACKGROUND OF THE INVENTION

The invention relates to toilet bowl cleaners, and more particularly to a dispenser for solid toilet bowl cleaner, wherein provision is made for adjustment of the amount of cleaner dispensed into the toilet tank water.

Toilet bowl cleaners have been in wide use, generally dispensing either a liquid into the water of the toilet tank or dissolving a solid cleaning agent into the water as the tank water surges during flushing. Usually a color is included in the toilet bowl cleaning agent, to indicate the presence of the cleaning agent.

Liquid toilet bowl cleaners have sometimes included a valve to dispense a measured amount of the cleaner liquid as the toilet is flushed and the water level in the tank falls. Solid cleaners have usually relied simply on the communication of the solid cake of cleaner with moving water in the tank, particularly during flushing, to effect the dissolving of the cleaner into the water.

There have been some solid toilet bowl cleaner dispensers which have included a rotatable member or collar on a cap, for adjusting and regulating the amount of toilet bowl cleaner that is dissolved into the tank water. Such an adjustable dispensing closure has generally included a series of holes in the annular collar, which can be placed in registry with, out of registry or partially in registry with similarly positioned holes in a stationary cap member, leading to the interior of the container. One such adjustable dispenser closure is shown in U.S. Pat. Des. No. 231,985. It has also been known on such a rotatable collar type adjustable dispenser closure to provide an annular band which closely fits over the annular surface of a stationary cap member, with an annular protruding ridge provided on the stationary cap member at the location of the top of the rotatable annular band. In such a closure a series of holes in the band were closely fitted against holes in the stationary cap member.

However, no toilet bowl cleaner dispenser system previous to the present invention was as efficient in construction and reliable in snap-together assembly, while permitting relatively broad manufacturing tolerances, as explained below with reference to the present invention.

SUMMARY OF THE INVENTION

In the present invention an adjustable dispenser type closure for solid toilet bowl cleaner includes a stationary cap portion which may be press-fit onto the top of a bottle or other vessel containing the solid toilet bowl cleaner. The stationary cap portion has an annular generally cylindrical outer surface, which may be slightly tapered in the form of a truncated cone, with a series of openings positioned around its periphery, enabling communication of toilet tank water with the interior of the bottle.

Onto this cap portion is fitted an annular band which lies ajacent to the annular array of openings in the cap member. The annular band may be slightly tapered, in the form of a truncated cone, complementary to the ajacent exterior surface of the cap member.

The annular band is manually rotatable on the stationary cap, and includes a series of openings of similar shape to those of the cap and capable of being in full registry with the openings in the cap by proper rotational alignment. Such position of full registry provides the maximum communication of the tank water with the toilet bowl cleaner and thus the heaviest concentration of toilet bowl cleaner solution into the water.

However, the band may be manually adjusted to throttle the series of holes to any extent desired, down to virtually total closure of the holes.

The manner of retention of the bowl cleaner adjustment band to the stationary cap member is an important feature of the invention. A pronounced annular ridge is provided on the stationary cap member, preferably at the level of the top edge of the annular adjustment band, when the adjustment band is its assembled position. The adjustment band does not fit tightly against the annular ridge of the cap member, but rather fits freely over the annular ridge and is retained in place by a series of nipples or bumps molded into the inside surface of the annular band. In assembly, wherein the annular band is pushed down over the cap member, the series of nipples engage the pronounced annular ridge, are forced outwardly slightly, with slight deformation of the annular band, and then clear the ridge and snap into place under the ridge.

This retention system holds the annular adjustment band tightly on the exterior of the stationary cap member, permitting manual rotation of the adjustment band to achieve desired settings of cleaner to be dispensed. Also, this retention system of the invention enables relatively broad manufacturing tolerances relating to the diameter of the stationary cap portion, the maximum diameter of the annular ridge on the cap portion, the inside diameter of the annular adjustment band, and the size and spacings between the nipples on the inside surface of the adjustment band.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

DESCRIPTION OF PREFERRED EMBODIMENTS

Figure 1:
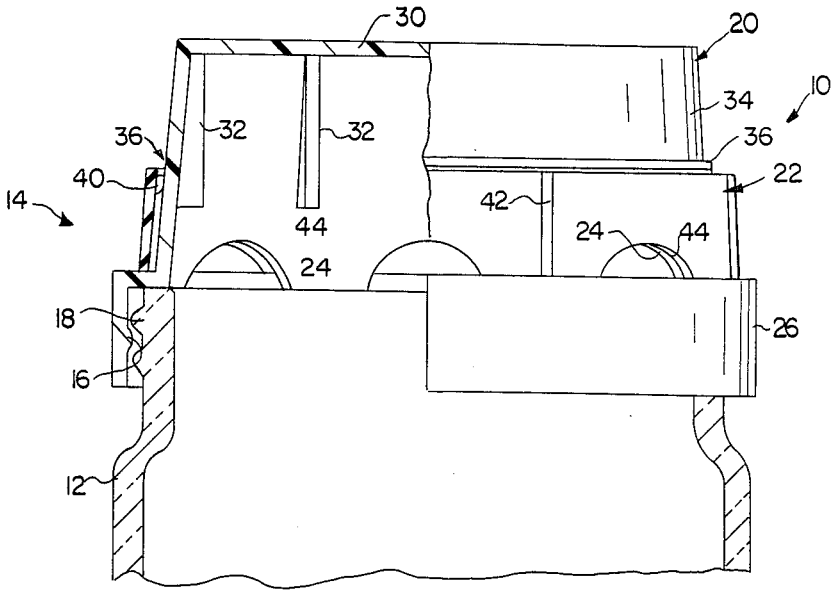
FIG. 1 is a view in elevation, partially in section, showing a toilet bowl cleaner dispenser bottle and closure in accordance with the invention, for regulating the amount of solid toilet bowl cleaner dispensed from the bottle into solution in the toilet tank water.

In the drawings, FIG. 1 shows a dispenser assembly 10 for solid toilet bowl cleaner, to be contained in a bottle 12 of the assembly. A dispenser closure generally identified at 14 is snapped onto the mouth of the bottle 12 by a series of annularly arranged tapered ridges 16 which snap into an annular groove 18 on the bottle mouth when the closure is pushed downwardly onto the bottle. The tapered ridges 16 are also shown in FIG. 3, as viewed from the bottom of the dispenser closure 14.

The dispenser closure 14 comprises a cap portion 20 and a band 22 which snaps into place on the exterior of the cap portion 20 in a manner such as to permit rotation of the band, as further explained below.

Figure 2:
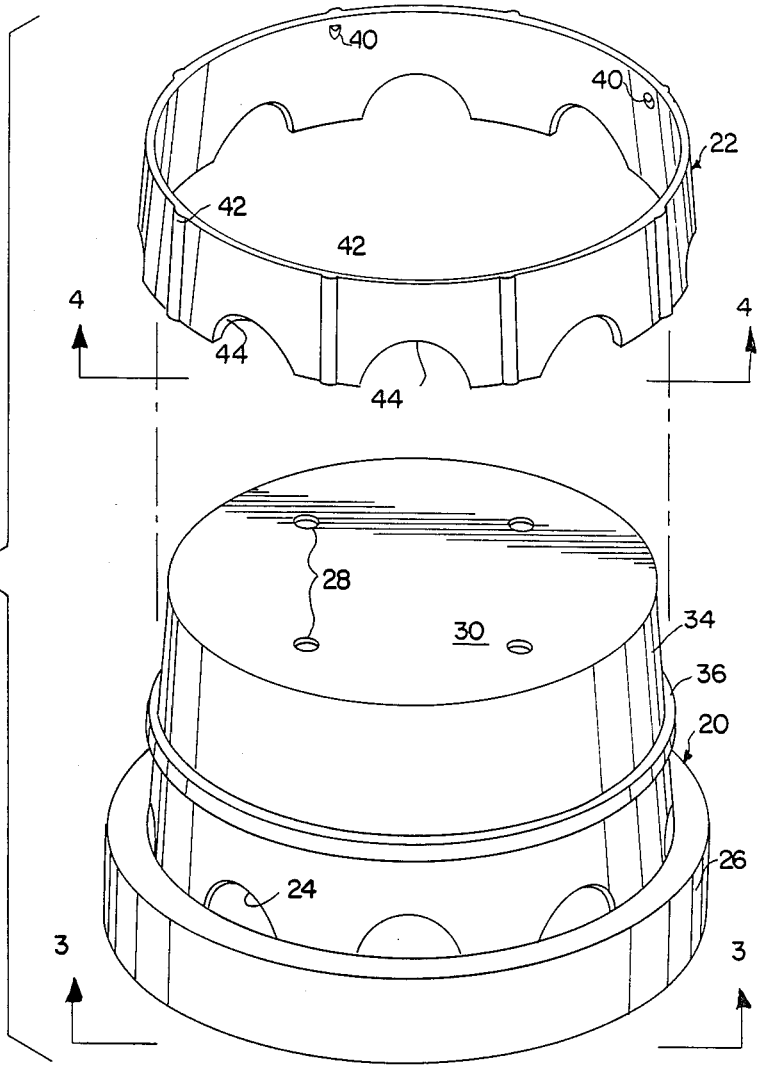
FIG. 2 is an exploded view in perspective showing the dispenser closure, with an adjustment band disassembled from a cap portion of the closure.

As shown in FIG. 1 and also FIG. 2, the cap portion 20 of the dispenser closure has a series of openings 24 around its periphery, just above a collar or rim portion 26 which has the tapered ridges 16 on its interior. The openings 24, which establish fluid communication of toilet tank water with the interior of the closure and bottle 12 and therefore with the solid toilet bowl cleaner within the bottle, may be semicircular in shape as shown in the drawings.

Figure 3:
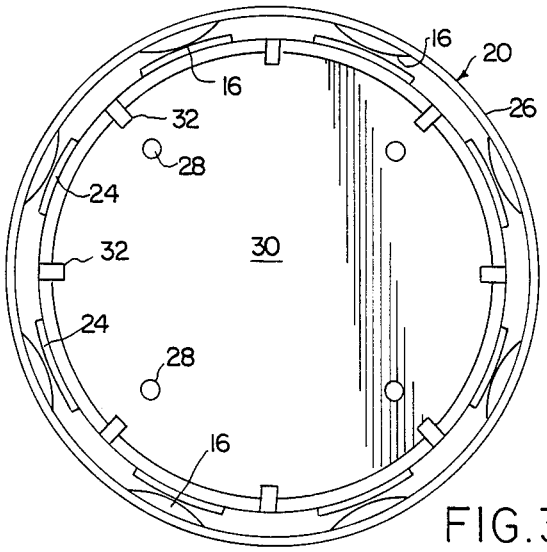
FIG. 3 is a bottom plan view of the cap portion of the closure.

The bottom plan view of FIG. 3 shows that the cap portion 20 of the closure preferably has a plurality of small holes 28, which may be approximately 1/16 inch to ⅛ inch in diameter. These holes in the top panel 30 of the cap portion will permit a minimum communication of toilet tank water with the solid toilet bowl cleaner in any circumstances.

As also shown in the bottom plan view of FIG. 3 as well as in the sectioned portion of FIG. 1, the cap portion 26 preferably includes a plurality of strengthening ribs 32 extending generally vertically with respect to the preferred orientation of the bottle 12 and spaced radially around the interior of a skirt portion 34 which is generally cylindrical, but may be somewhat tapered as discussed further below.

As shown in all of the figures, the preferred shape of the skirt portion 34 of the cap, and of the adustment band 22, is slightly tapered, i.e. in the shape of a truncated cone. The interior of the band 22 is shaped complementarily to the exterior of the skirt portion 34 of the cap 20 and, as indicated in FIG. 1 and in the exploded view of FIG. 2, the band is received down over the exterior of the skirt portion 34 of the cap. The band is loosely received over the top of the cap and is pushed down over a pronounced ridge 36 extending annularly on the exterior of the skirt portion 34. The band 22 has a interior diameter sized to be freely received over the pronounced annular ridge 36 on the cap, and sized to fit somewhat loosely on the lower portion of the skirt 34 in the assembled configuration. The interior diameter band of the band might be, for example, about 0.010 inch to 0.040 inch larger than the exterior diameter of the skirt 34, in the assembled configuration. This allows considerable tolerance in the manufacture of both the cap 20 and the band 22.

Figure 4:
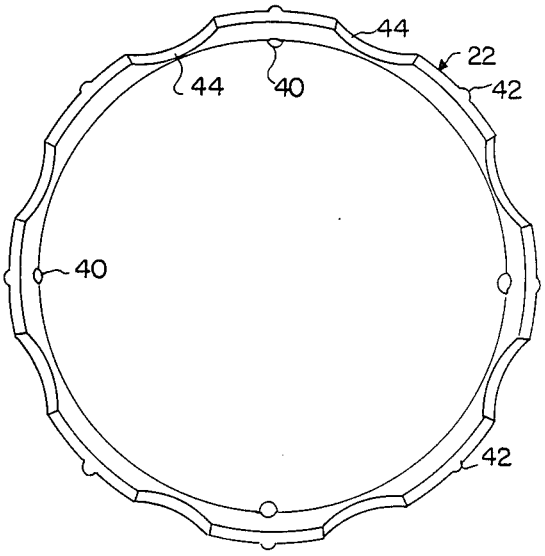
FIG. 4 is a bottom plan view of the adjustment band of the dispenser closure.

To snap and lock the band in place on the cap 20, preferably in a position just beneath the annular ridge 36, there are provided on the interior of side of the band 22 a plurality of nipples 40 extending inwardly. These nipples 40, shown in FIG. 4, are preferably at or closely adjacent to the upper edge of the band 22 and may protrude about 0.020" to 0.035" inwardly from the interior surface of the band 22. There may be four of these nipples, and in any event at least three.

On assembly, the band 22 is placed downwardly over the cap portion 20 as indicated in FIG. 2. The band 22 slips easily over the top of the cap portion and also slips freely over the pronounced annular band 36, since all diameters on the band 22 preferably are at least sightly larger than the exterior diameter of the pronounced ridge 36.

Thus, the adustment band 22 moves easily down over the ridge 36, until the nipples 40 engage against the ridge 36, at which point considerable resistance is encountered. The band is then forced further down onto the cap portion 20 until the nipples clear and snap over the pronounced ridge 36 which involves a slight deformation or out-of-roundness of the band 22. The nipples snap under the pronounced ridge 36, and the adustment band 22 is locked securely in place against the upper edge of the collar 26 of the cap portion. The nipples 40 on the band 22 are shaped such that they have tapered, ramp-shaped lower sides and upper sides which are sharply abutment-shaped to provide a snap fit with the ridge 36. The nipples 40 may be of such size as to create a slight degree of friction providing light resistance against rotation of the band 22 on the cap portion 20. In this way, while the band may be easily rotated on the cap portion, the slight degree of resistance assures that the adjustment band will remain in a position to which it is rotated.

It should be understood that the locking ridge 36 need not be at the level shown on the cap portion 20, although this is preferred. For example, it could be somewhat lower, with the nipples 40 of the band 22 also being somewhat lower so that the band still snaps into place in the same position on the cap 20.

As shown in FIGS. 1, 2 and 4, the band 22 may include a series of generally vertically disposed ridges 42 on its exterior, for the purpose of providing a grip for the user of the toilet cleaner dispenser bottle 10.

As shown in the drawings, the band 22 includes a series of openings 44 positioned to be capable of registry with the openings 24 in the cap portion. The band openings 44 may be of the same shape as the cap openings 24 although somewhat dissimilar shapes could also be used. In the drawings the openings 44 are shown as generally semicircular in shape, actually comprising cutouts in the band, extending up from the bottom edge of the band.

In operation of the dispenser device of the invention, the adustment band 22 is rotated to the fully open poisiton shown in FIG. 1 if maximum concentration of toilet cleaning agent is desired in the toilet tank water. In this position, all of the band openings 44 are fully in registry with the cap openings 24, for maximum communication of the tank water with the interior of the bottle.

Figure 5:
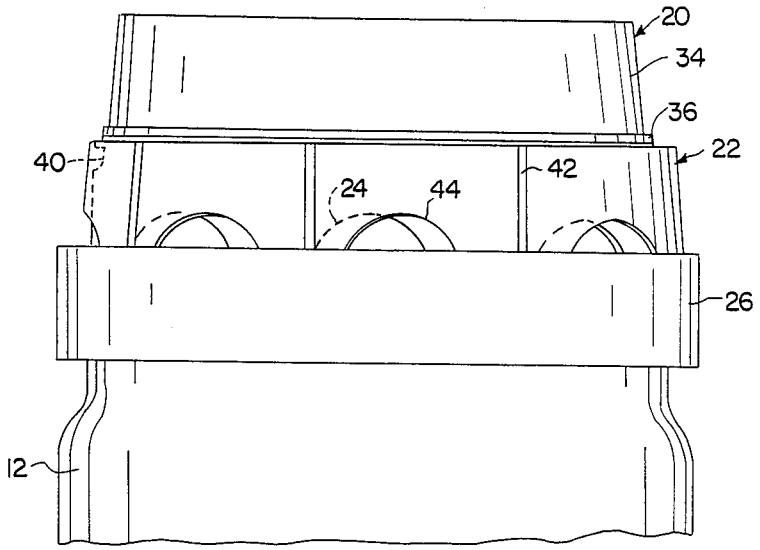
FIG. 5 is an elevation view of the toilet bowl cleaner dispenser, showing a different position of adustment from that of FIG. 1.

When a lower concentration of a cleaning agent is desired in the water, the band 22 is simply rotated manually to a position wherein the band openings 44 are not fully in registry with the cap openings 24, to a desired degree, as illustrated in FIG. 5. Thus, the cap openings 24 may be at any desired partially open setting, as shown in FIG. 5, or they may be substantially fully closed.

As discussed above, even at a fully closed position, the closure 10 permits some communication of the tank water with the toilet cleaning agent in the bottle, via the fixed holes 28 in the top panel 30 of the cap (FIGS. 2 and 3).

While I have illustrated and described the preferred embodiments of my invention, it is to be understood that these are capable of variation and modification and I therefore do not wish to be limited to the precise details set forth, but desire to avail myself of such changes and alterations as fall within the following claims.

I claim:

1. A regulator closure for a bottle of the kind adapted to contain a toilet bowl cleaner substance in solid form in the bottle, with the bottle to be placed in a toilet tank, said regulator closure comprising, a cap having a series of cap openings arranged annularly on the cap so as to permit communication of toilet tank water through the cap openings with the solid toilet bowl cleaner in the bottle, a manually rotatable annular band shaped complementarily to the exterior of the cap and fitted for rotation on the exterior of the cap, the annular band having a series of band openings shaped similarly to the cap openings and being registrable with the cap openings, the annular band including a plurality of nipples on its interior side, protruding from an interior surface of the band, an annular ridge on the exterior of the cap, sized to receive the annular band over the ridge and positioned for engagement by the plurality of nipples of the band when the band is assembled on the cap and for retaining the band in position on the cap when the nipples are engaged with and snapped over the annular ridge by assembling the annular band downwardly onto the cap and forcing it down to form the annular band out-of-round temporarily as the nipples are engaged with and forced outwardly by the annular ridge, the diameter of the annular band being such as to freely pass over the ridge except for the protusion of the nipples which provide an interfering engagement with the ridges, and the nipples on the band having tapered, ramp-shaped lower sides and upper sides which are sharply abutment-shaped, so that the nipples snap into place under the ridge on assembly and lock the annular band on the cap, and wherein both the cap, and wherein both the cap and the band are generally in the shape of complementarily-fitted truncated cones, and wherein the annular closure band in its assembled position lies beneath the annular ridge on the cap, with the nipples on the interior of the annular band being substantially at the upper edge of the annular band.

2. The improvement of claim 1, wherein the cap has a top panel with a plurality of holes which are permanently open, to provide a minimum communication of toilet tank water into the bottle.

* * * * *